US007535286B2

(12) United States Patent
Shimada

(10) Patent No.: US 7,535,286 B2
(45) Date of Patent: May 19, 2009

(54) CONSTANT CURRENT SOURCE APPARATUS INCLUDING TWO SERIES DEPLETION-TYPE MOS TRANSISTORS

(75) Inventor: Eiji Shimada, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 195 days.

(21) Appl. No.: 11/049,720

(22) Filed: Feb. 4, 2005

(65) Prior Publication Data

US 2005/0174165 A1 Aug. 11, 2005

(30) Foreign Application Priority Data

Feb. 5, 2004 (JP) ..... 2004-029390

(51) Int. Cl.
*G05F 1/10* (2006.01)
*G05F 3/02* (2006.01)

(52) U.S. Cl. ..... 327/543

(58) Field of Classification Search ..... 327/538, 327/540, 541, 543

See application file for complete search history.

(56) References Cited

U.S. PATENT DOCUMENTS 5,774,011 A * 6/1998 Au et al. ..... 327/525
6,005,378 A 12/1999 D'Angelo et al. ..... 323/313
6,114,906 A 9/2000 Fukui ..... 330/252
6,144,248 A * 11/2000 Oosugi et al. ..... 327/525
6,198,337 B1 * 3/2001 Matsuura ..... 327/525

FOREIGN PATENT DOCUMENTS

JP 5-13686 1/1993

* cited by examiner

*Primary Examiner*—Quan Tra
(74) *Attorney, Agent, or Firm*—McGinn IP Law Group, PLLC

(57) ABSTRACT

In a constant current source apparatus for supplying a load current to at least one load, first and second output terminals are provided, and at least one of the first and second output terminals is capable of being connected to the load. First and second depletion-type MOS transistors are connected in series between the first and second output terminals. A source and a gate of the first depletion-type MOS transistor are connected to a gate of the second depletion-type MOS transistor.

10 Claims, 12 Drawing Sheets

CONSTANT CURRENT SOURCE APPARATUS INCLUDING TWO SERIES DEPLETION-TYPE MOS TRANSISTORS

BACKGROUND OF THE INVENTION

1. Field of the Invention

The present invention relates to a constant current source apparatus for supplying a constant current to at least one load.

2. Description of the Related Art

A prior art constant current source apparatus is constructed by a gate-source short-circuited depletion-type metal oxide semiconductor (MOS) transistor connected between a load connected to a power supply terminal and a ground terminal, so that a load current flowing through the load is made constant (see: FIG. 5 of JP-5-13686-A). This will be explained later in detail.

In the above-described prior art constant current source apparatus, however, when a voltage applied thereto fluctuates, the load current would fluctuate due to the channel length modulation effect of the depletion-type MOS transistor.

Also, in the above-described prior art constant current source apparatus, where the voltage applied thereto is too high, no use is made of a low drain-to-source breakdown depletion-type MOS transistor, which would increase the layout area and degrade the current characteristics.

SUMMARY OF THE INVENTION

It is an object of the present invention to provide a constant current source apparatus capable of suppressing the fluctuation of a load current due to the channel length modulation effect.

Another object of the present invention is to provide a constant current source apparatus capable of decreasing the layout area and improving the current characteristics.

According to the present invention, in a constant current source apparatus for supplying a load current to at least one load, first and second output terminals are provided, and at least one of the first and second output terminals is capable of being connected to the load. First and second depletion-type MOS transistors are connected in series between the first and second output terminals. A source and a gate of the first depletion-type MOS transistor are connected to a gate of the second depletion-type MOS transistor.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENTS

Before the description of the preferred embodiments, a prior art constant current source apparatus will be explained with reference to FIG. 1 (see: FIG. 5 of JP-5-13686-A).

Figure 1:
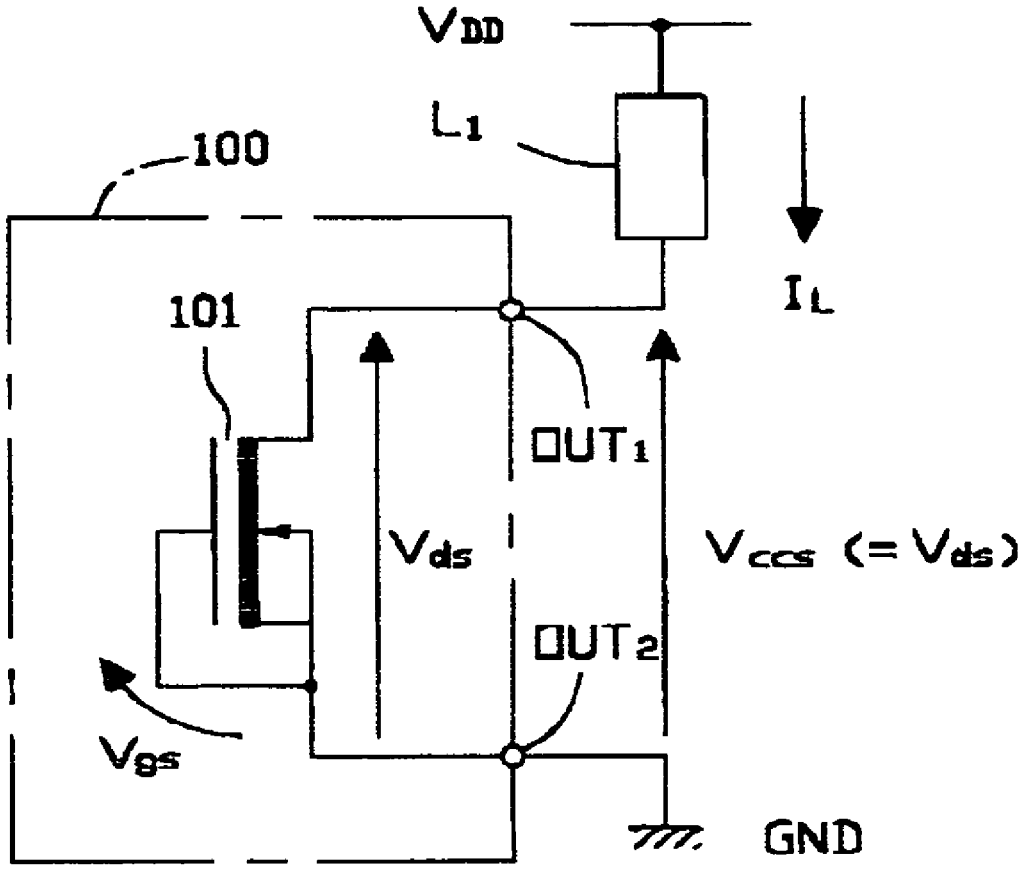
Fig. 1 Prior Art
FIG. 1 is a circuit diagram illustrating a prior art constant current source apparatus.

In FIG. 1, a constant current source apparatus 100 has an output terminal $OUT_1$ connected to a load $L_1$ which is further connected to a power supply terminal to which a power supply voltage $V_{DD}$ is applied, and an output terminal $OUT_2$ connected to a ground terminal to which a ground voltage GND is applied.

Figure 2:
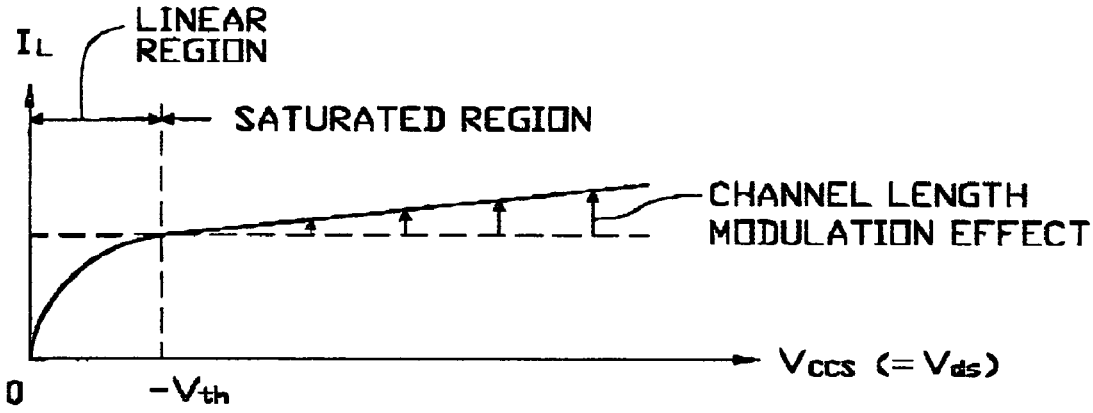
Fig. 2 Prior Art
FIG. 2 is a graph showing the current characteristics of the load current of FIG. 1.

The constant current source apparatus 100 is constructed by a depletion-type N-channel MOS transistor 101 with a source connected to the ground terminal (GND), a gate connected to the source, a drain connected to the load $L_1$ and a back gate connected to the source. Therefore, since the gate-to-source voltage of the depletion-type N-channel MOS transistor 101 is 0V, a saturated drain current flowing therethrough, i.e., a load current $L_1$ flowing through the load $L_1$ is limited in a saturated region where a voltage $V_{ccs}$ applied to the constant current source apparatus 100, i.e., the drain-to-source voltage $V_{ds}$ of the depletion-type N-channel MOS transistor 101 is higher than an absolute value of a threshold voltage $V_{th}$ thereof, as shown in FIG. 2. Thus, a constant load current $I_L$ equal to the saturated drain current of the depletion-type N-channel MOS transistor 101 flows through the load $L_1$ under a condition that $V_{ccs}(=V_{ds}) \geqq V_{th}$.

Note that, the larger the voltage $V_{CCS}$, the higher the drain-to-source breakdown voltage of the depletion-type N-channel MOS transistor 101. Also, the higher this drain-to-source breakdown voltage, the larger the threshold voltage $V_{th}$.

In the constant current source apparatus 100 of FIG. 1, however, when the voltage $V_{CCS}$ fluctuates, the load current $I_L$ would fluctuate due to the channel length modulation effect of the depletion-type N-channel NOS transistor 101. That is, as shown in FIG. 2, when the voltage $V_{CCS}$ is increased, the drain-to-source voltage of the depletion-type N-channel MOS transistor 101 is directly increased, so that the load current $I_L$ would be increased by the channel length modulation effect.

Also, in the constant current source apparatus 100 of FIG. 1, where the voltage $V_{ccs}$ is too high, no use is made of a low drain-to-source breakdown depletion-type MOS transistor, which would increase the layout area and degrade the current characteristics, since a high drain-to-source breakdown depletion-type MOS transistor generally has a larger layout area and degraded current characteristics such as a degraded constant current characteristic, a degraded temperature dependency and a degraded diffusion fluctuation, than a low drain-to-source breakdown-type MOS transistor.

Figure 3:
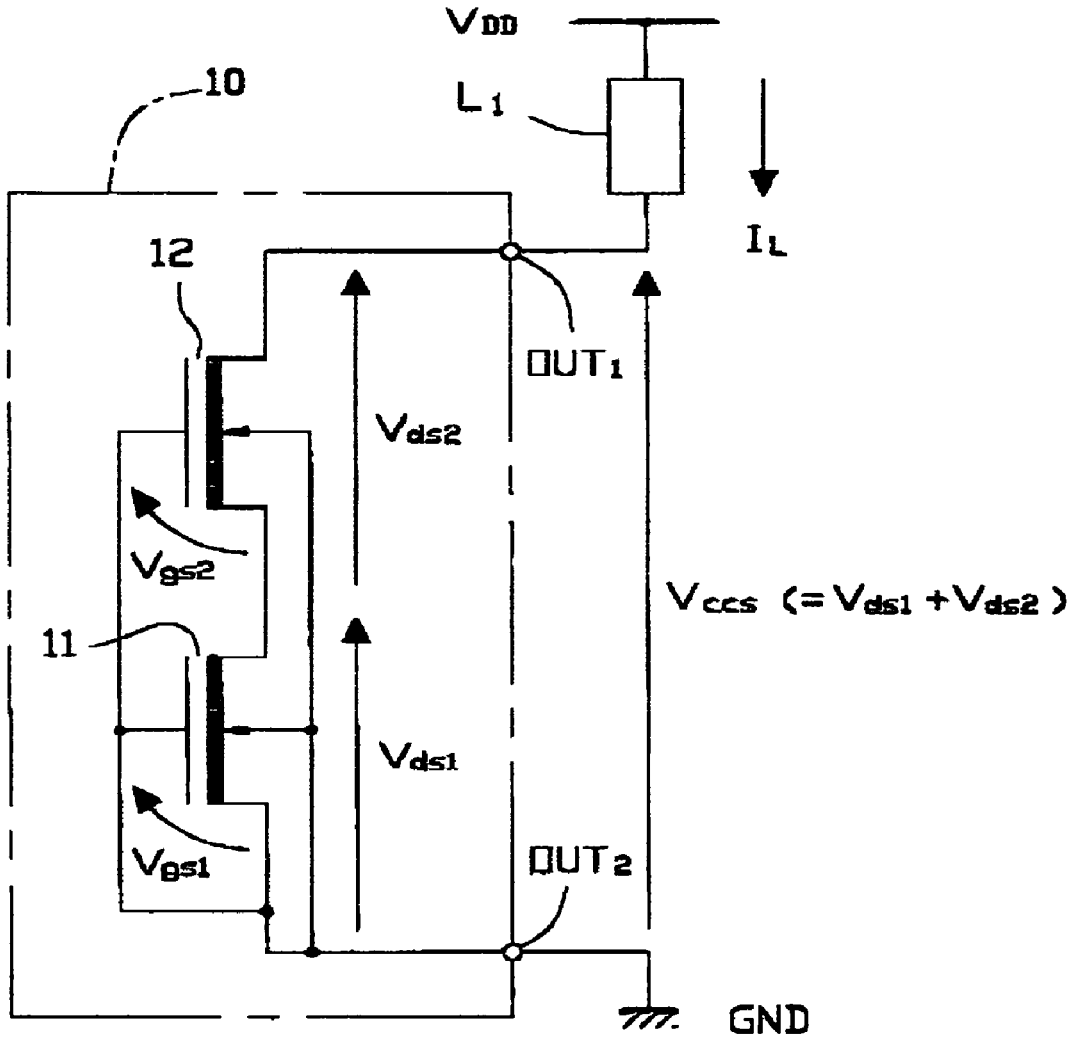
FIG. 3 is a circuit diagram illustrating a first embodiment of the constant current source apparatus according to the present invention.

In FIG. 3, which illustrates a first embodiment of the constant current source apparatus according to the present invention, a constant current source apparatus 10 is constructed by depletion-type MOS N-channel transistors 11 and 12 connected in series between the output terminals $OUT_1$ and $OUT_2$. In this case, a source and a gate of the depletion-type N-channel MOS transistor 11 is connected to a source of the depletion-type N-channel MOS transistor 12. Also, back gates of the depletion-type N-channel MOS transistors 11 and 12 are directly grounded.

In FIG. 3, $$V_{ds1}=-V_{gsZ} \tag{1}$$

where $V_{ds1}$ is a drain-to-source voltage of the depletion-type N-channel MOS transistor 11; and $V_{gsZ}$ is a gate-to-source voltage of the depletion-type N-channel MOS transistor 12.

In FIG. 3, a voltage $V_{ccs}$ is applied to the constant current source apparatus 10, and a load current $I_L$ flows through the load $L_1$.

Figure 4:
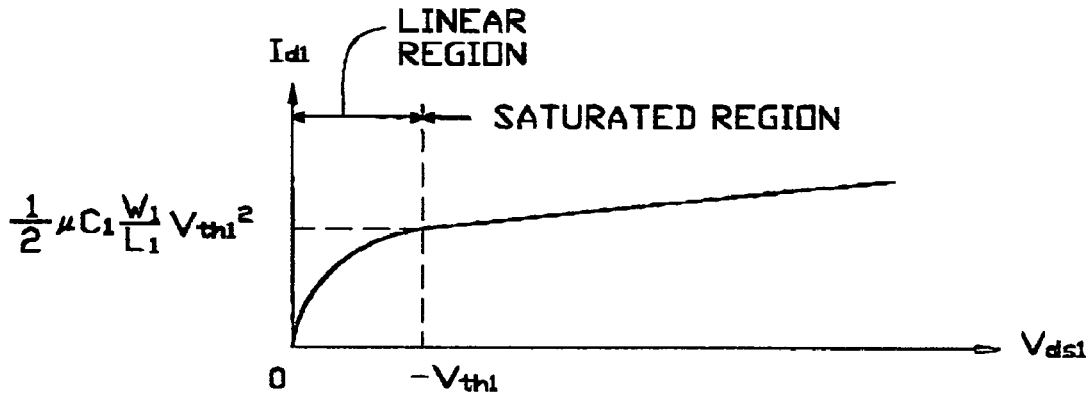
FIG. 4 is a graph showing the current characteristics of the first depletion-type N-channel MOS transistor of FIG. 3.

As shown in FIG. 4, as the drain-to-source voltage $V_{ds1}$ of the depletion-type N-channel MOS transistor 11 is increased, the drain current $I_{d1}$ of the depletion-type N-channel MOS transistor 11 is gradually increased in a linear region where $V_{ds1}$ is between 0 and $-V_{th1}$ where $V_{th1}$ is a negative threshold voltage of the depletion-type N-channel MOS transistor 11. Also, in a saturated region where the drain-to-source voltage $V_{ds1}$ is higher than $-V_{th1}$, the drain current $I_{d1}$ is saturated but increased a little by the channel length modulation effect.

Figure 5A:
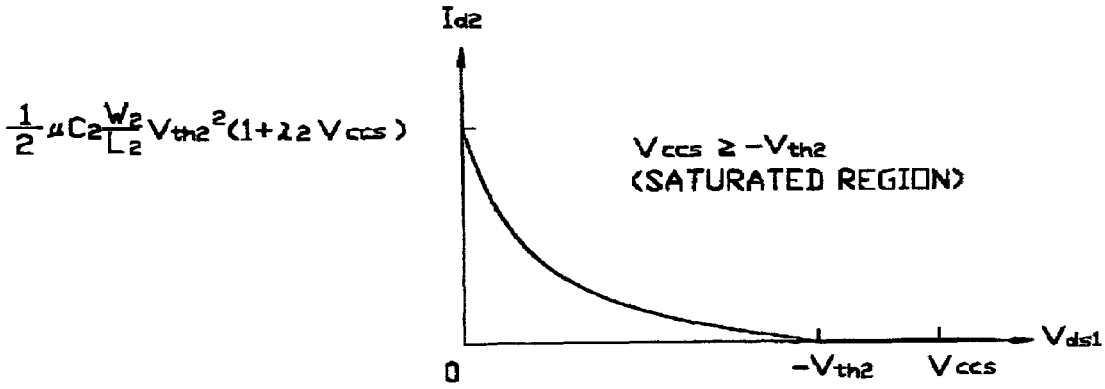
FIGS. 5A and 5B are graphs showing the current characteristics of the second depletion-type N-channel MOS transistor of FIG. 3.
Figure 5B:
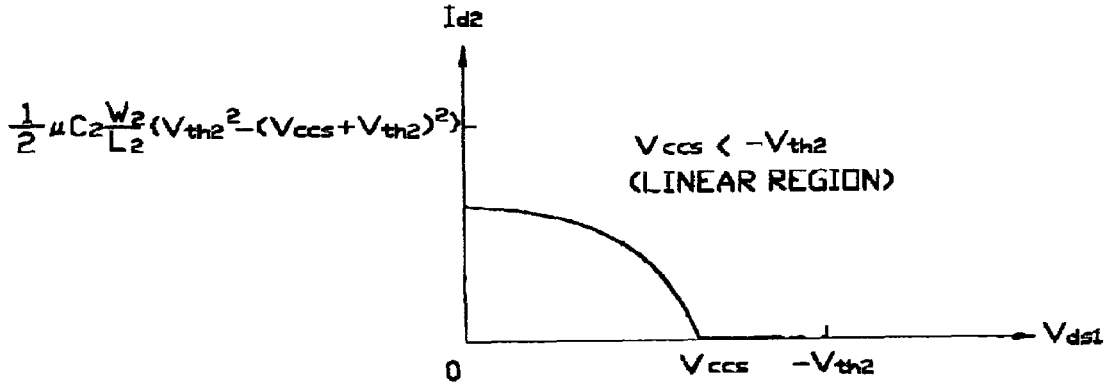

On the other hand, as shown in FIGS. 5A and 5B, as the drain-to-source voltage $V_{ds2}$ of the depletion-type N-channel MOS transistor 12 is increased, the drain current $I_{d2}$ of the depletion-type N-channel MOS transistor 12 is gradually decreased. In more detail, as shown in FIG. 5A, when $V_{CCS}\geqq-V_{thZ}$ (saturated region), the drain current $I_{d2}$ is gradually decreased between $V_{ds2}=0$ and $V_{ds2}=-V_{th2}$ where $V_{th2}$ is a negative threshold voltage of the depletion-type N-channel MOS transistor 12, and when the drain-to-source voltage $V_{dsZ}$ is higher than $-V_{th2}$, the drain current $I_{d2}$ is 0. Also, as shown in FIG. 5B, when $V_{CCS}<-V_{th2}$ (linear region), the drain current $I_{dz}$ is gradually decreased between $V_{ds2}=0$ and $V_{ds2}=V_{CCS}$, and when the drain-to-source voltage $V_{ds2}$ is higher than $V_{CCS}$, the drain current $I_{dZ}$ is 0.

Figure 6A:
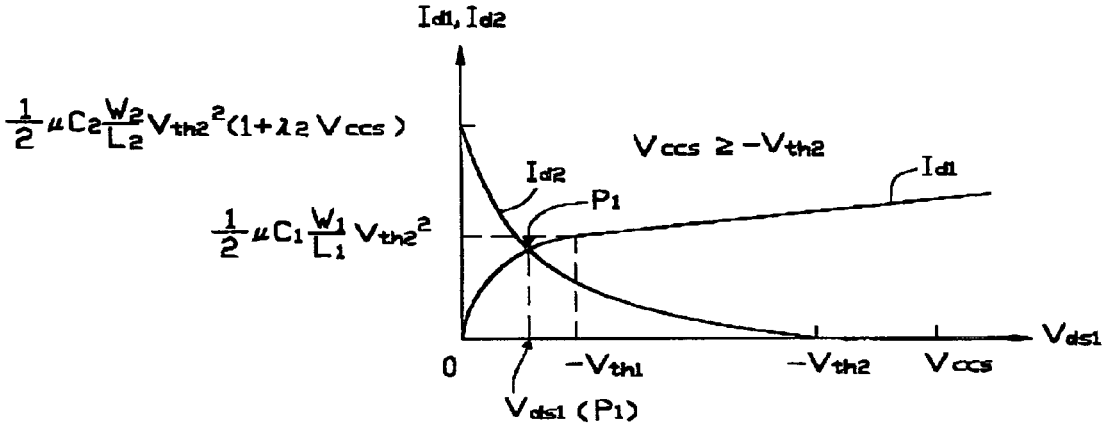
FIGS. 6A and 6B are graphs showing the operating point of the constant current source apparatus of FIG. 3.
Figure 6B:
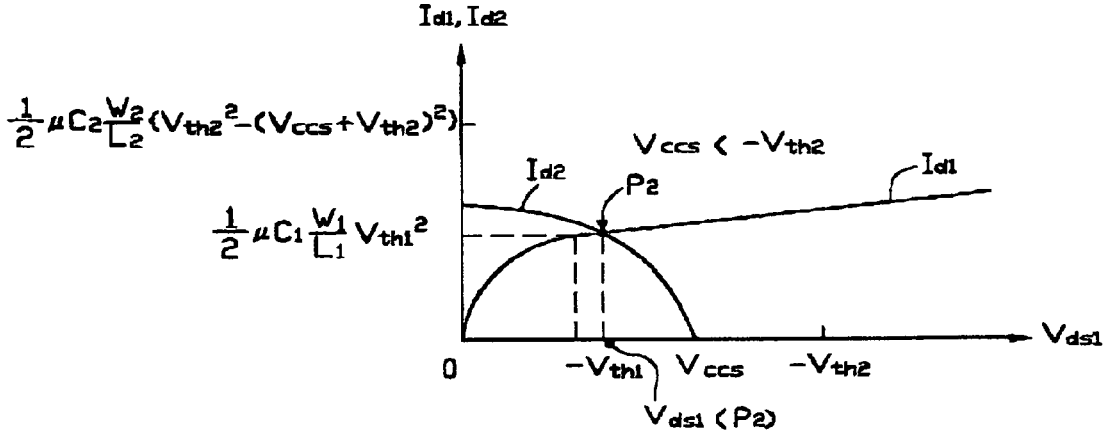

Therefore, when combining the current characteristics of FIG. 4 with the current characteristics of FIGS. 5A and 5B, only one operating point $P_1$ or $P_2$, where the drain current $I_{d1}$ of the depletion-type N-channel MOS transistor 11 coincides with the drain current $I_{d2}$ of the depletion-type N-channel MOS transistor 12, always exists, as shown in FIGS. 6A and 6B. In this case, the drain-to-source voltage $V_{ds1}$ ($P_1$) or $V_{ds1}$ ($P_2$) at the operating point $P_1$ or $P_2$ is smaller than $-V_{th2}$, i.e., $$V_{ds1}(P_1)<-V_{th2} \tag{2}$$

$$V_{ds1}(P_2)<V_{th2} \tag{3}$$

Thus, the drain-to-source voltage $V_{ds1}$ of the depletion-type N-channel MOS transistor 11 at the operating points $P_1$ and $P_2$ is smaller than $-V_{th2}$.

Therefore, the drain-to-source breakdown voltage of the depletion-type N-channel MOS transistor 11 can be small; In this case, the minimum value of this breakdown voltage is $-V_{th2}$, i.e., this breakdown voltage is not smaller than $-V_{thz}$. As a result, a low drain-to-source breakdown voltage depletion-type MOS transistor can be used for the depletion-type N-channel MOS transistor 11. On the other hand, the minimum value of the drain-to-source breakdown voltage of the depletion-type N-channel MOS transistor 12 is $V_{DD}$, i.e., this breakdown voltage is not smaller than $V_{DD}$. As a result, a high drain-to-source breakdown voltage depletion-type MOS transistor is used for the depletion-type N-channel MOS transistor 12. Note that low breakdown voltage MOS transistors are generally excellent in temperature dependency of current, between-element fluctuation as compared with high breakdown voltage MOS transistors.

The operating point $P_1$ or $P_2$ where is unambiguously determined set forth below with reference to FIGS. 4, 5A, 5B, 6A and 6B.

As shown in FIG. 4, the drain current $I_{d1}$ of the depletion-type N-channel MOS transistor 11 is represented by $$I_{d1}=\mu C_1-(W_1/L_1)-\{(V_{gs1}-V_{th1})-V_{ds1}-(1\tfrac{1}{2})-V_{ds1}^2\}\text{for } V_{ds1}\leqq V_{gs1}-V_{th1}\text{ (linear region)} \tag{4}$$

$$I_{d1}=(\tfrac{1}{2})-\mu C_1-(W_1/L_1)-(V_{gs1}-V_{thi})^2-(1+\lambda_1 V_{ds1})\text{ for } V_{ds1}>V_{gs1}-V_{th1}\text{ (saturated region)} \tag{5}$$

$C_1$ is a gate capacitance per unit area;
$W_1$ is a gate width;
$L_1$ is a gate length;
$V_{gs1}$ is a gate-to-source voltage;
$V_{th1}$ (<0) is a threshold voltage;
$\lambda_1$ (>0) is a channel length modulation factor; and
$V_{ds1}$ is a drain-to-source voltage.

Since $V_{gs1}=0$, the formulae (4) and (5) are replaced by $$I_{d1}=(\tfrac{1}{2})-\mu C_1-(W_1/L_1)-\{V_{th1}^2-(V_{ds1}+V_{th1})^2\}\text{for } V_{ds1}\leqq V_{gs1}V_{th1}\text{ (linear region)} \tag{6}$$

$$I_{d1}=(\tfrac{1}{2})-\mu C_1-(W_1/L_1)-V_{th1}^2(1+\lambda_1 V_{ds1})\text{ for } V_{ds1}>V_{gs1}-V_{th1}\text{ (saturated region)} \tag{7}$$

Also, in FIG. 5A, since $V_{ccs}\geqq-V_{thZ}$, $$\begin{aligned} V_{ds2} &= V_{ccs}-V_{ds1} \\ &= V_{ccs}+V_{gs2} \\ &\geqq V_{gs2}-V_{th2} \end{aligned}$$

Thus, the depletion-type N-channel MOS transistor 12 is operated in a saturated region. Therefore, the drain current $I_{d2}$ of the depletion-type N-channel MOS transistor 12 is represented by $$I_{d2}=(\tfrac{1}{2})-\mu C_2(W_2/L_2)-(V_{gs2}-V_{th2})^2(1+\lambda_Z V_{ds2})\text{ for } V_{ds2}>V_{th2}\text{ (saturated region)} \tag{8}$$

$C_2$ is a gate capacitance per unit area;
$W_Z$ is a gate width;
$L_Z$ is a gate length;
$V_{gs2}$ is a gate-to-source voltage;
$V_{th2}$ (<0) is a threshold voltage;
$\lambda_Z$ (>0) is a channel length modulation factor; and
$V_{ds2}$ is a drain-to-source voltage.

Further, in FIG. 5B, since $V_{ccs}<-V_{th2}$, $$\begin{aligned} I_{d2} &= V_{ccs}-V_{ds1} \\ &= V_{ccs}+V_{gs2} \\ &< V_{gs2}-V_{th2} \end{aligned}$$

Thus, the depletion-type N-channel MOS transistor 12 is operated in a linear region. Therefore, the drain current $I_{d2}$ of the depletion-type N-channel NOS transistor 12 is represented by $$I_{d2}=\mu V_2-(W_2/L_2)-\{(V_{gs2}-V_{th2})-V_{ds2}-(\tfrac{1}{2})-V_{ds2}^2\}\text{for } V_{ccs}<-V_{th2}\text{ (linear region)} \tag{9}$$

The formulae (8) and (9) are combined with the formula (1) to obtain the following formulae (10) and (11):

$$I_{d2}=(½)-\mu C_2(W_2/L_2)-(V_{ds1}+V_{th2})^2-(1+\lambda \text{for } V_{ccs}\geqq-V_{th2} \quad (10)$$

$$I_{d2}=\mu C_2(W_2/L_2)\cdot\{-(V_{dS1}+V_{th2})\cdot V_{ds2}-(½)\cdot V_{ds2}^2\} \text{ for } V_{ccs}<-V_{th\,2} \quad (11)$$

Since $V_{ds2}=V_{ccs}-V_{ds1}$, the formulae (10) and (11) are replaced by:

$$I_{d2}=(½)\cdot\mu C_2\cdot(W_2/L_2)\cdot(V_{ds1}-V_{th2})\cdot\{1+\lambda_2(V_{ccs}-V_{ds1})\} \text{ for } V_{ccs}\geqq-V_{th2} \quad (12)$$

$$I_{d2}=(½)\cdot\mu C_2\cdot(W_2/L_2)\cdot\{(V_{ds2}+V_{th2})^2\cdot(V_{ccs}-V_{thZ})\}^2\} \text{for } V_{ccs}<-V_{th2} \quad (13)$$

Thus, the drain-to-source voltage $V_{ds1}$ ($P_1$) is obtained by solving the formula (4) or (5) and the formula (12) under a condition that $I_{d1}=I_{d2}$. Also, the drain-to-source voltage $V_{ds1}$ ($P_2$) is obtained by solving the formula (4) or (5) and the formula (13) under a condition that $I_{d1}=I_{d2}$.

The current fluctuation of the constant current source apparatus 10 of FIG. 3 caused by the channel length modulation effect will be explained below.

First, assume that:

$$|V_{th1}|<|V_{th2}| \quad (14)$$

That is, the absolute value of the threshold voltage $V_{th1}$ of the depletion-type N-channel MOS transistor 11 is smaller than that of the threshold voltage $V_{th2}$ of the depletion-type N-channel MOS transistor 12.

Second, assume that:

$$\mu C_1-W_1/L_1<<\mu C_2-W_2/L_2 \quad (15)$$

That is, the current drive ability of the depletion-type N-channel MOS transistor 11 is much smaller than that of the depletion-type N-channel KOS transistor 12.

Finally, assume that:

$$\lambda_1=\lambda_2=\lambda \quad (16)$$

That is, the channel length modulation factor of the depletion-type N-channel MOS transistor 11 is equal to that of the depletion-type N-channel MOS transistor 12.

The conditions defined by the formulae (14), (15) and (16) can easily be realized by a conventional semiconductor manufacturing process.

Figure 7A:
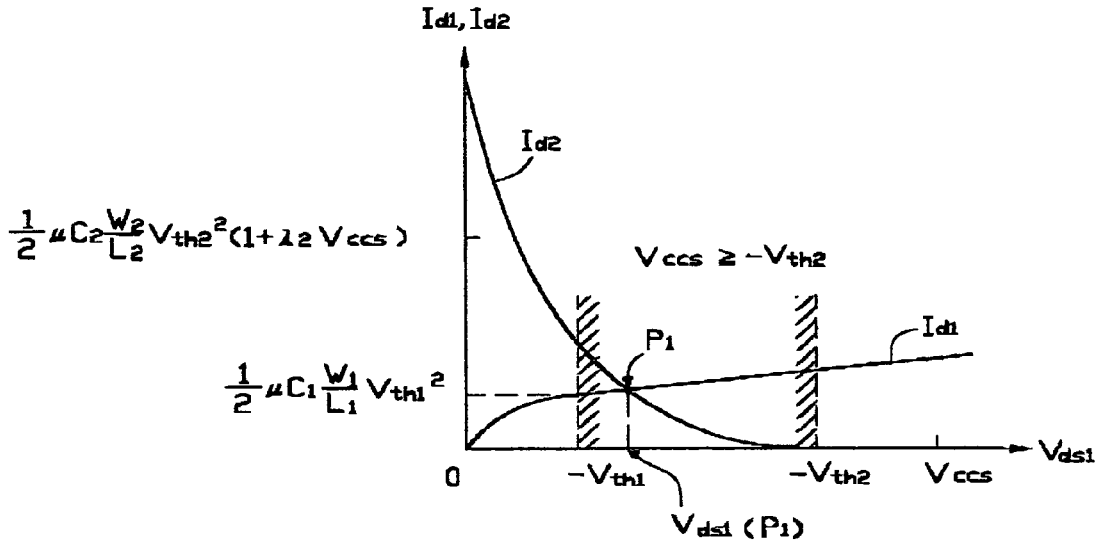
FIGS. 7A and 7B are graphs showing the special operating point of the constant current source apparatus of FIG. 3.

As shown in FIG. 7A, when $V_{ccs}\geqq-V_{th2}$, the drain-to-source voltage $V_{ds1}(P_1)$ at the operation point $P_1$ is between $-V_{th1}$ and $-V_{th2}$. Therefore, the channel length modulation effect term $\lambda^*V_{ds1}$ is changed betweenk $\lambda\cdot(-V_{th1})$ and $\lambda\cdot(-V_{th2})$ so that the fluctuation of the channel length modulation effect term is limited by $\lambda\cdot(V_{th1}-V_{th2})$. Thus, the fluctuation of the load current $I_L$ by the channel length modulation effect can be suppressed.

In the constant current source apparatus 100 of FIG. 1, note that the channel length modulation effect term $\lambda\cdot V_{ds}$ is changed between $\lambda\cdot(-V_{th1})$ and $\lambda\cdot V_{ccs}$ so that the fluctuation of the channel length modulation effect term is limited by $\lambda\cdot(V_{th1}+V_{ccs})$.

As shown in FIG. 79, when $V_{ccs}<-V_{thZ}$, the drain-to-source voltage $V_{ds1}$ ($P_2$) at the operating point $P_Z$ is between $-V_{th1}$ and $V_{ccs}$. Therefore, the channel length modulation effect term $\lambda\cdot V_{ds1}$ is changed between $\lambda\cdot(-V_{th1})$ and $\lambda\cdot V_{ccs}$, so that the fluctuation of the channel length modulation effect term is limited by $\lambda\cdot(V_{th1}-V_{ccs})$. Thus, the fluctuation of the load current $I_L$ by the channel length modulation effect can be suppressed in the same way as in the constant current source apparatus 100 of FIG. 1. However, even when the voltage $V_{ccs}$ is too highs the depletion-type N-channel MOS transistor 11 can be constructed by a low drain-to-source breakdown voltage N-channel MOS transistor while the depletion-type N-channel MOS transistor 12 can be constructed by a high drain-to-source breakdown voltage N-channel MOS transistor, so that the fluctuation of the load current $I_L$ by the channel length modulation effect can be suppressed.

The layout area of the constant current source apparatus of FIG. 3 will be explained below.

Assume that:

$$|V_{th1}|<<|V_{th2}| \quad (17)$$

$$\mu C_1=\mu C_2 \quad (18)$$

$$W_1=W_2=W_{min} \text{ (minimum rule) } (19)$$

$$L_1=L_2=L_{min} \text{ (minimum rule) } (20)$$

$$\lambda_1=\lambda_2=\lambda \quad (21)$$

Figure 7B:
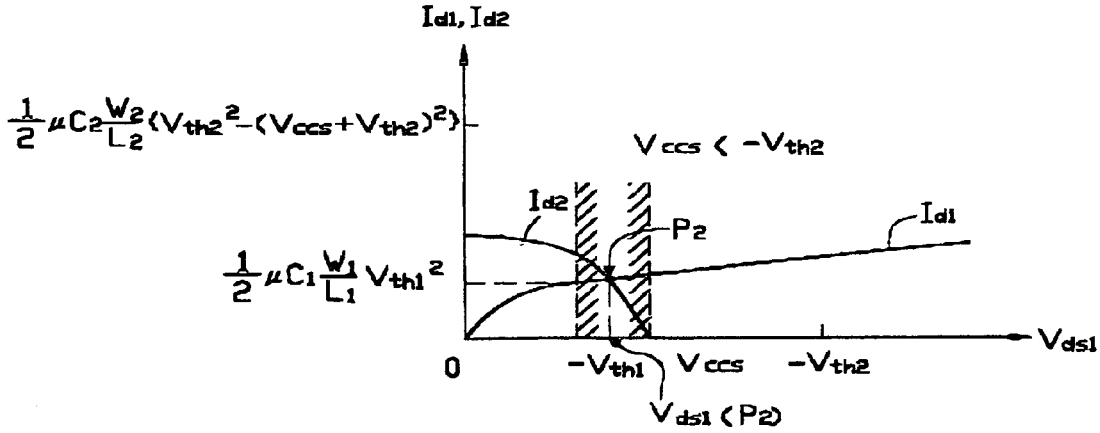

The conditions defined by the formulae (17), (18), (19), (20) and (21) can also be easily realized by a conventional semiconductor manufacturing process. In this case, operating points P, and $P_2$ are also shown in FIGS. 7A and 7B.

The load current $I_L$ is proportional to the square value of a threshold voltage which is defined by $V_{th1}$ of the depletion-type N-channel NOS transistor 11 of FIG. 3 or $V_{th}$ of the depletion-type N-channel MOS transistor 101 of FIG. 1.

Therefore, in order to make the load current $I_L$ in the constant current source apparatus 10 of FIG. 3 equal to the load current $I_L$ in the constant current source apparatus 100 of FIG. 1, the ratio of the gate length of the depletion-type N-channel MOS transistor 11 to the depletion-type MOS transistor 101 is $V_{th1}^2/V_{th}^2$ (<1). That is, the gate length of the depletion-type N-channel MOS transistor 11 is $L_{sin}$, while the gate length of the depletion-type N-channel MOS transistor 101 is $(V_{th}^2/V_{th1}^2)\,L_{sin}$, so that the gate area of the depletion-type N-channel MOS transistor 11 is $W_{min}\cdot L_{sin}$, while the gate area of the depletion-type N-channel MOS transistor 101 is $(V_{th}^2/V_{th1}^2)\,W_{sin}\cdot L_{sin}$. In this case, the total gate area of the depletion-type N-channel MOS transistors 11 and 12 is $2\cdot W_{sin}\cdot L_{min}$ 101 of FIG. 1 (see: formula (7)). In this case, a low drain-to-source breakdown voltage MOS transistor is used for the depletion-type N-channel MOS transistor 11 of FIG. 3, while a high drain-to-source breakdown voltage MOS transistor is used for the depletion-type N-channel MOS transistor 101 of FIG. 1. As a result, $$V_{th1}<V_{th} \quad (22)$$

Since the layout area of a constant current source apparatus is considered to be proportional to the total gate area thereof, if $V_{th}^2/V_{th1}^2>2$, the layout area can be decreased.

Figure 8:
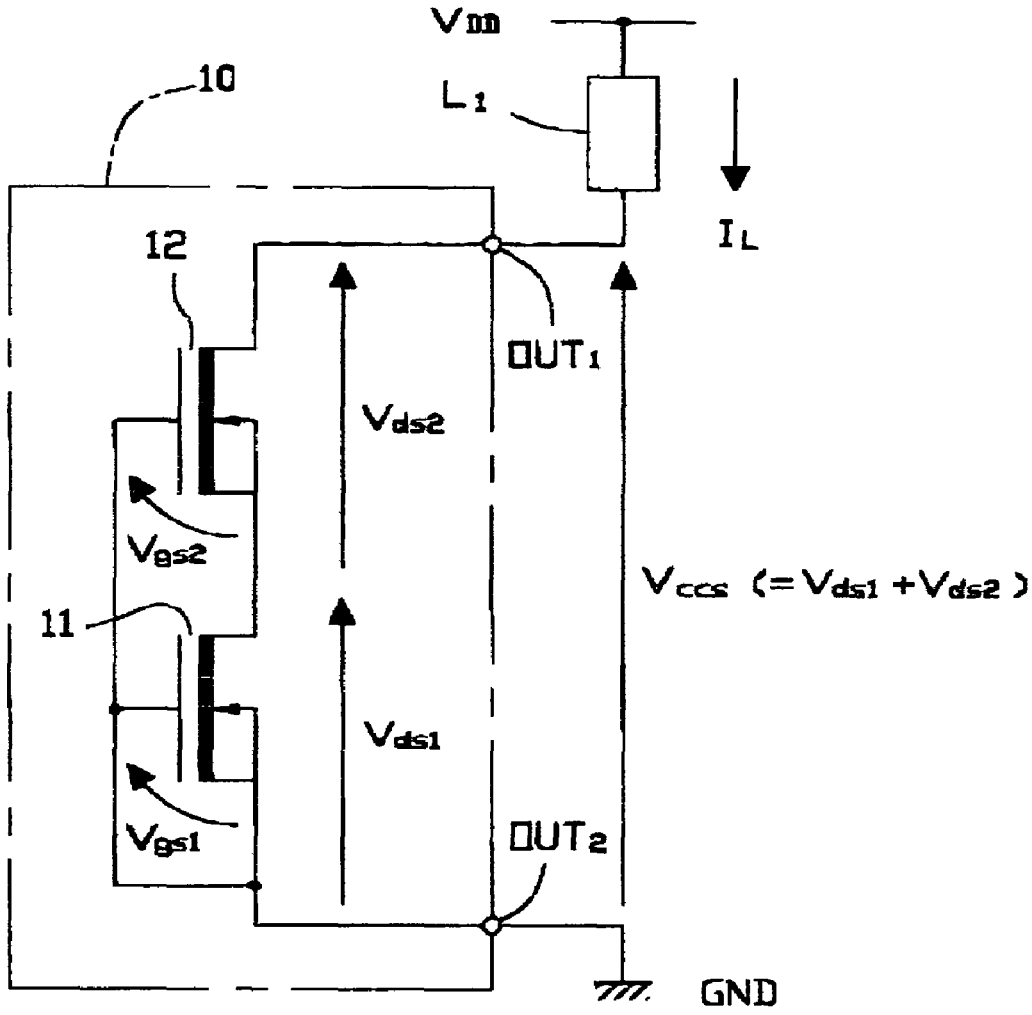
FIG. 8 is a circuit diagram illustrating a modification of the constant current source apparatus of FIG. 3.

In FIG. 8, which illustrates a modification of the constant current source apparatus 10 of FIG. 3, the back gates of the depletion-type N-channel MOS transistor 11 and 12 are connected to the corresponding sources thereof. That is, in FIG. 3, since the back gates of the depletion-type N-channel MOS transistors 11 and 12 are connected to the source of the depletion-type N-channel MOS transistor 11, the depletion-type N-channel MOS transistors 11 and 12 can be formed within the same P-type well. On the other hand, in FIG. 8, since the back gates of the depletion-type N-channel MOS transistor 11 and 12 are connected to the sources of the depletion-type N-channel MOS transistors 11 and 12, respectively, the depletion-type N-channel MOS transistors 11 and 12 can be formed within different two P-type wells.

Figure 9:
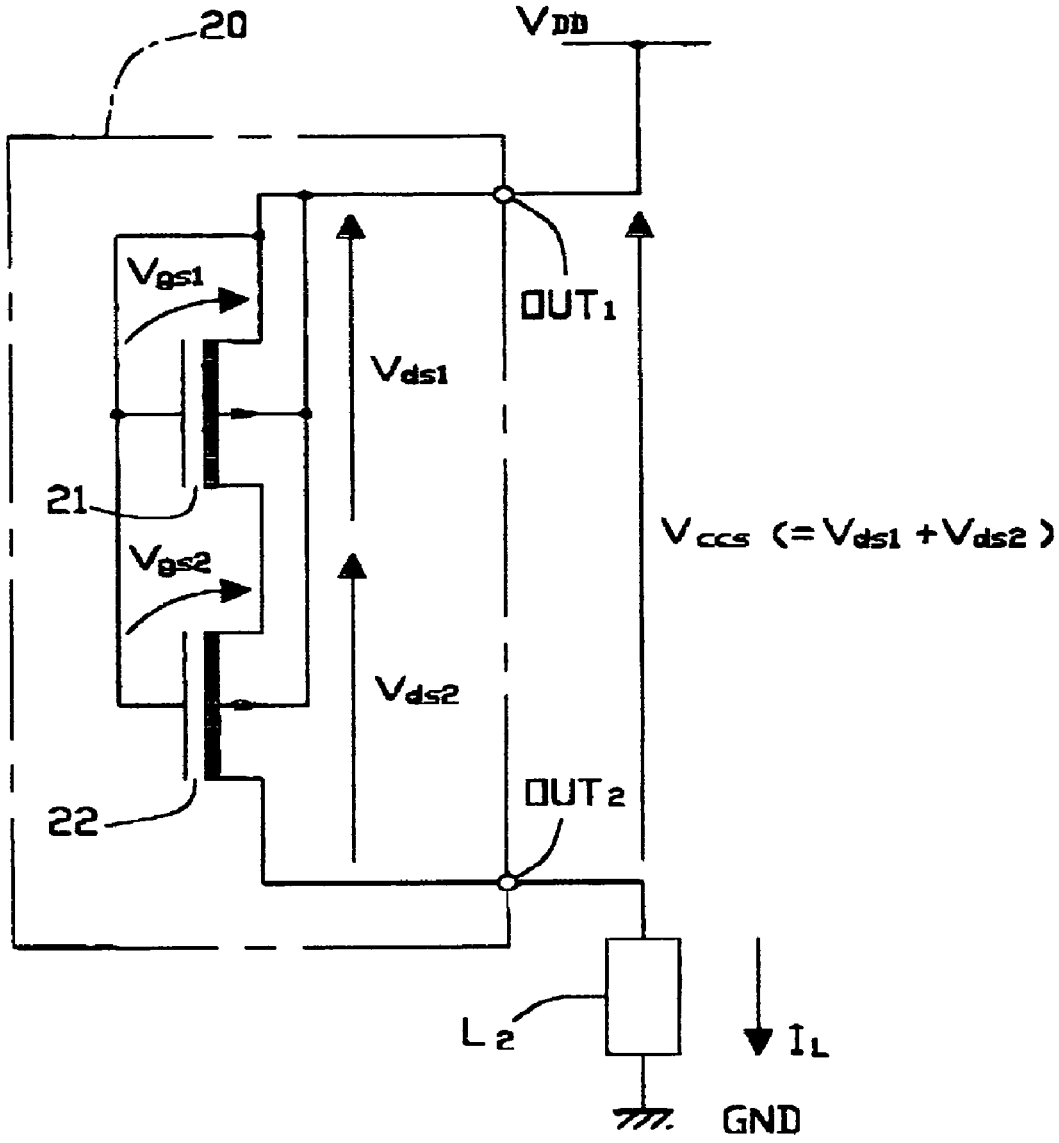
FIG. 9 is a circuit diagram illustrating a second embodiment of the constant current source apparatus according to the present invention.

In FIG. 9, which illustrates a second embodiment of the constant current source apparatus according to the present invention, a constant current source apparatus 20 has an output terminal $OUT_1$ connected to a power supply terminal to which a power supply voltage $V_{DD}$ (>0) is applied and an output terminal $OUT_E$ connected to a load $L_2$ which is further connected to a ground terminal to which the ground voltage GND is applied.

The constant current source apparatus 20 Is constructed by depletion-type MOS P-channel transistors 21 and 22 connected in series between the output terminals $OUT_1$ and $OUT_2$. In this case, a source and a gate of the depletion-type P-channel MOS transistor 21 are connected to a source of the depletion-type N-channel MOS transistor 22. Also, back gates of the depletion-type P-channel MOS transistors 21 and 22 are directly connected to the power supply terminal ($V_{DD}$).

That is, in FIG. 9, the depletion-type N-channel MOS transistors 11 and 12 of FIG. 3 are replaced by the depletion-type P-channel MOS transistors 21 and 22, respectively, The operation of the constant current source apparatus 20 of FIG. 9 is similar to that of the constant current source apparatus 10 of FIG. 3.

Figure 10:
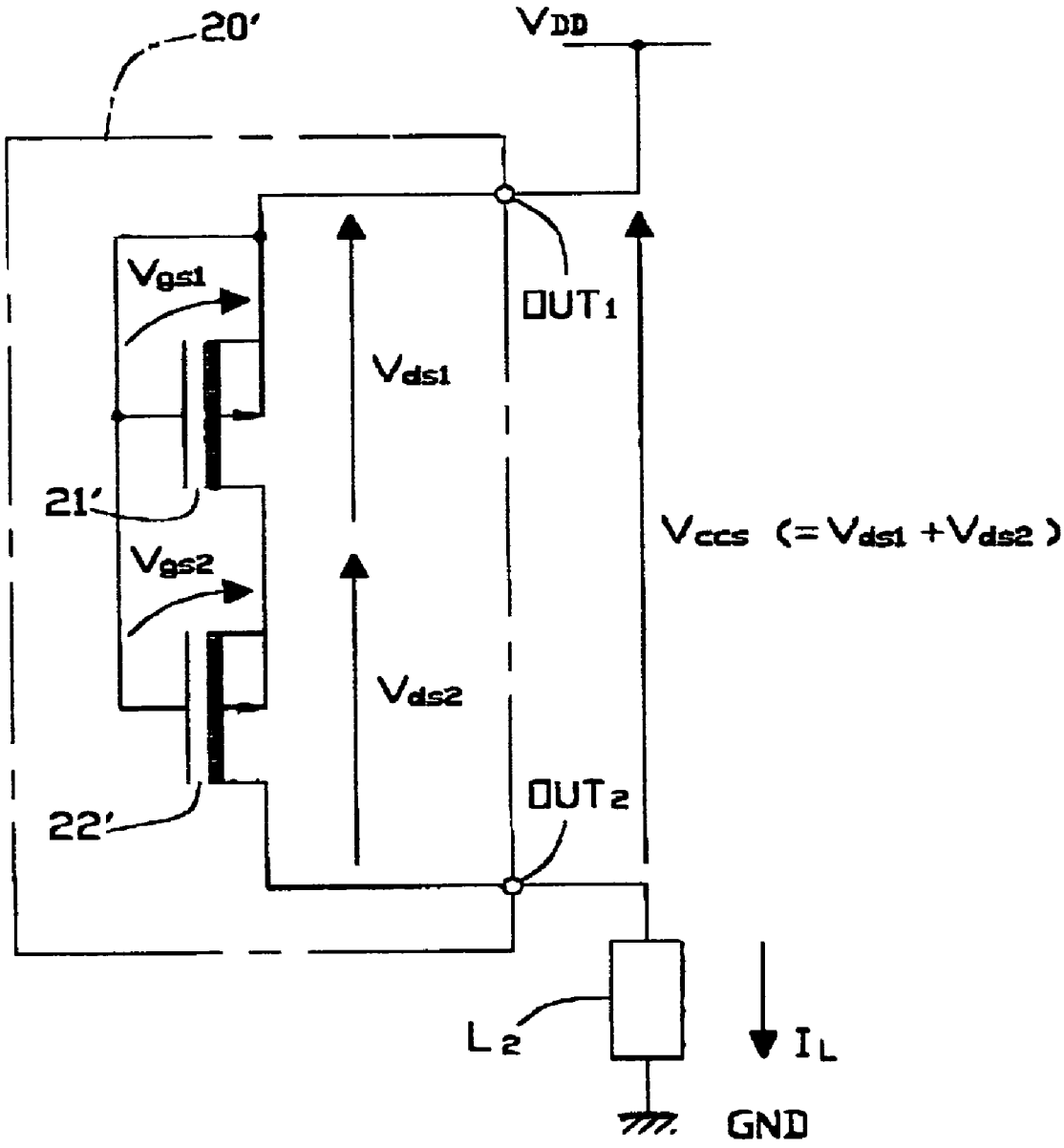
FIG. 10 is a circuit diagram illustrating a modification of the constant current source apparatus of FIG. 9.

In FIG. 10, which illustrates a modification of the constant current source apparatus 20 of FIG. 9, the back gates of the depletion-type P-channel MOS transistor 21 and 22 are connected to the corresponding sources thereof. That is, in FIG. 9, since the back gates of the depletion-type P-channel MOS transistors 21 and 22 are connected to the source of the depletion-type P-channel MOS transistor 21, the depletion-type P-channel MOS transistors 21 and 22 can be formed within the same N-type well. On the other hand, in FIG. 10, since the back gates of the depletion-type P-channel MOS transistor 21 and 22 are connected to the sources of the depletion-type P-channel MOS transistors 21 and 22, respectively, the depletion-type P-channel MOS transistors 21 and 22 can be formed within two different N-type wells.

Figure 11:
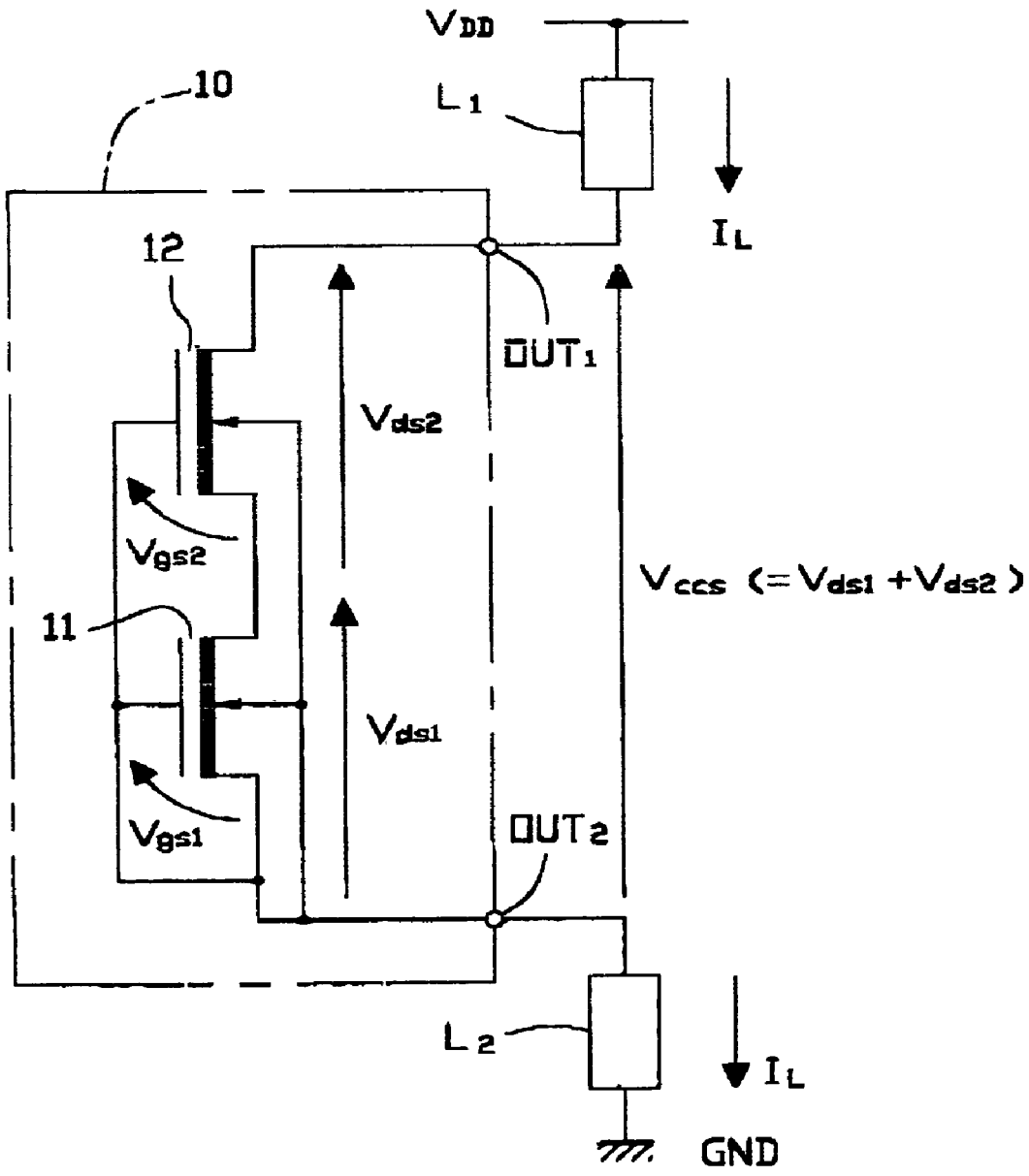
FIGS. 11 and 12 are circuit diagrams illustrating modifications of the constant current source apparatuses of FIGS. 3 and 9, respectively.
Figure 12:
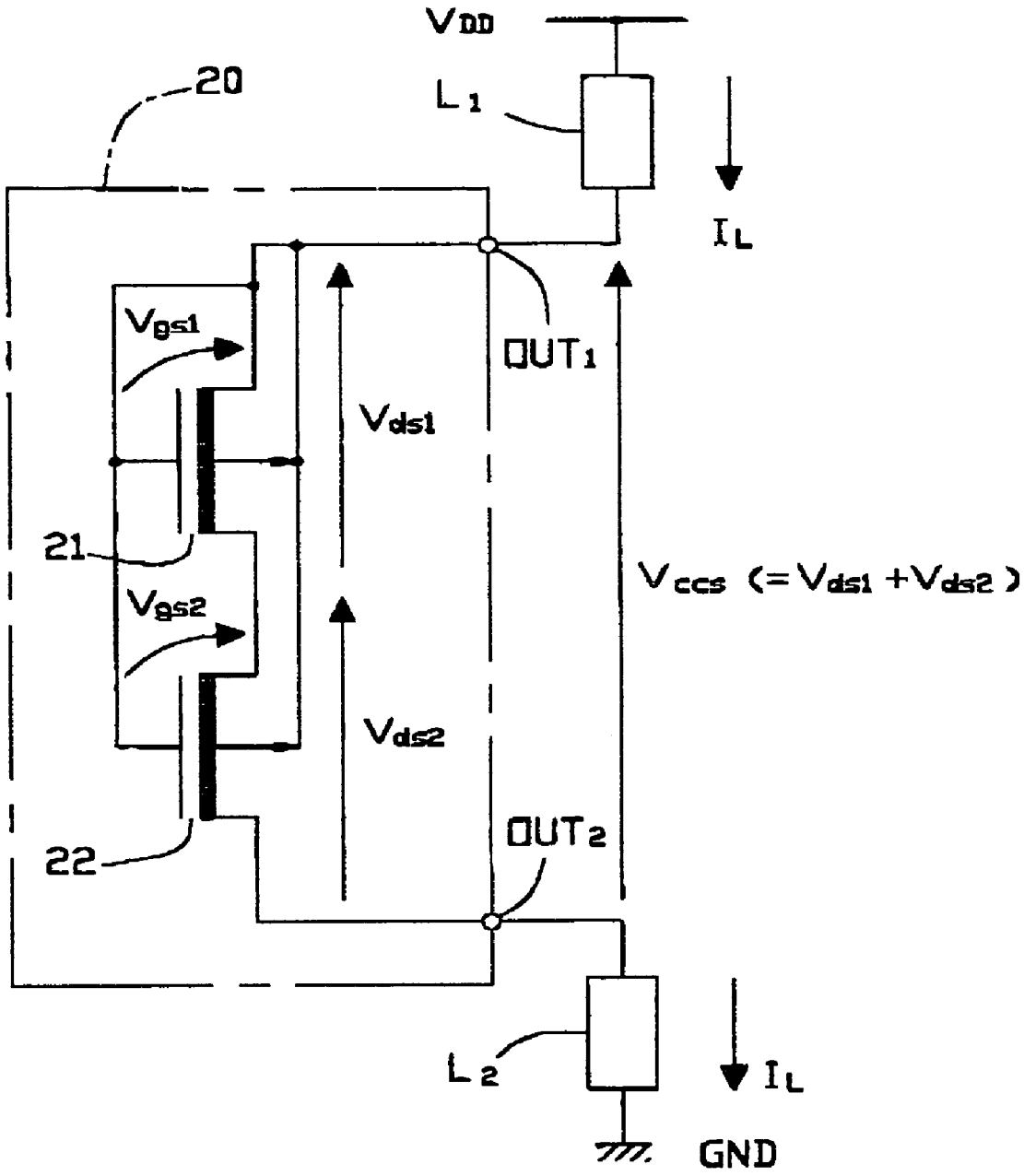

In the above-described embodiments, although the constant current source apparatus 10 or 20 is connected to one load $L_1$ or $L_2$, the constant current source apparatus can be connected to two loads $L_1$ and $L_2$ as illustrated in FIGS. 11 and 12.

As explained hereinabove, according to the present invention, the current fluctuation by the channel length modulation effect can be suppressed, and also, the layout area can be decreased while the current characteristics can be improved.

The invention claimed is:

1. A constant current source apparatus for supplying a load current to at least one load, comprising:

first and second output terminals, at least one of said first and second output terminals capable of being connected to said load; and first and second depletion-type MOS transistors connected in series between said first and second output terminals, wherein a source and a gate of said first depletion-type MOS transistor being connected to a gate of said second depletion-type MOS transistor, thereby to form said constant current source apparatus, and wherein said first and second depletion-type MOS transistors interact such that, when a voltage applied to said constant current source apparatus fluctuates, then said first and second depletion-type MOS transistors suppress a resulting fluctuation of said load current due to a channel length modulation effect, and wherein said channel-length modulation effect is thereby limited to be within the formula $\lambda\cdot(V_{th1}-V_{th2})$, where:

$\lambda$ is a channel-length modulation factor of said first and second depletion-type MOS transistors;

$V_{th1}$ is a threshold voltage of said first depletion-type MOS transistor; and $V_{th2}$ is a threshold voltage of said second depletion-type MOS transistor.

2. The constant current source apparatus as set forth in claim 1, wherein a drain-to-source breakdown voltage of said first depletion-type MOS transistor is larger than an absolute value of a threshold voltage of said second depletion-type MOS transistor.

3. The constant current source apparatus as set forth in claim 1, wherein an absolute value of a threshold voltage of said first depletion-type MOS transistor is smaller than an absolute value of a threshold voltage of said second depletion-type MOS transistor.

4. The constant current apparatus as set forth in claim 1, wherein a drain-to-source breakdown voltage of said first depletion-type MOS transistor is smaller than a drain-to-source breakdown voltage of said second depletion-type MOS transistor.

5. The constant current source apparatus as set forth in claim 1, wherein back gates of said first and second depletion-type MOS transistors are connected to the source of said first depletion-type MOS transistor.

6. The constant current source apparatus as set forth in claim 1, wherein a back gate of said first depletion-type MOS transistor is connected to the source of said first depletion-type MOS transistor, and a back gate of said second depletion-type MOS transistor is connected to the source of said second depletion-type MOS transistor.

7. The constant current source apparatus as set forth in claim 1, wherein each of said first and second depletion-type MOS transistors comprises a depletion-type N-channel MOS transistor.

8. The constant current source apparatus as set forth in claim 1, wherein each of said first and second depletion-type MOS transistors comprises a depletion-type P-channel MOS transistor.

9. A constant current source apparatus for supplying a load current to at least one load, comprising:

first and second output terminals, at least one of said first and second output terminals capable of being connected to said load; and first and second depletion-type MOS transistors connected in series between said first and second output terminals, a source and a gate of said first depletion-type MOS transistor being connected to a gate of said second depletion-type MOS transistor, wherein an absolute value of a threshold voltage of said first depletion-type MOS transistor is smaller than an absolute value of a threshold voltage of said second depletion-type MOS transistor, wherein a drain-to-source breakdown voltage of said first depletion-type MOS transistor is smaller than a drain-to-source breakdown voltage of said second depletion-type MOS transistor, wherein said first and second depletion-type MOS transistors operate together to suppress a fluctuation of said load current due to a channel-length modulation effect, and wherein said channel-length modulation effect is thereby limited by the formula $\lambda\cdot(V_{th1}-V_{th2})$, where:

$\lambda$ is a channel-length modulation factor of said first and second depletion-type MOS transistors;

$V_{th1}$ is a threshold voltage of said first depletion-type MOS transistor; and $V_{th2}$ is a threshold voltage of said second depletion-type MOS transistor.

10. A constant current source apparatus for supplying a load current to at least one load, comprising:

first and second output terminals, at least one of said first and second output terminals capable of being connected to said load; and first and second depletion-type MOS transistors connected in series between said first and second output terminals, wherein a source and a gate of said first depletion-type MOS transistor being connected to a gate of said second depletion-type MOS transistor, thereby to form said constant current source apparatus, and wherein said first and second depletion-type MOS transistors interact such that, when a voltage applied to said constant current source apparatus fluctuates, then said first and second depletion-type MOS transistors suppress a resulting fluctuation of said load current due to a channel length modulation effect, and wherein said channel-length modulation effect is limited by the formula $\lambda\cdot(V_{th1}-V_{ccs})$, where:

$\lambda$ is a channel-length modulation factor of said first and second depletion-type MOS transistors;

$V_{th1}$ is a threshold voltage of said first depletion-type MOS transistor; and $V_{ccs}$ is equal to a sum of a drain-to-source voltage of said first depletion-type MOS transistor and a drain-to-source voltage of said second depletion-type MOS transistor.

* * * * *